United States Patent [19]

Gilling et al.

[11] 4,371,553

[45] Feb. 1, 1983

[54] PACKAGE INCLUDING PRODUCT SUPPORT INSERT

[75] Inventors: Donald A. Gilling, Neenah, Wis.; Albert G. McCaskill, Minneapolis, Minn.

[73] Assignee: James River-Dixie/Northern, Inc., Greenwich, Conn.

[21] Appl. No.: 174,557

[22] Filed: Aug. 1, 1980

[51] Int. Cl.[3] ..... B65D 85/62; B65D 81/20; B65D 77/24; B65D 75/38

[52] U.S. Cl. ..... 426/124; 229/87 F; 426/121

[58] Field of Search ..... 426/124, 129, 121; 229/40, 87 F, 8

[56] References Cited

U.S. PATENT DOCUMENTS

| | | | |
|---|---|---|---|
| D. 235,974 | 7/1975 | Seiferth et al. | D9/99 |
| D. 250,173 | 11/1978 | Houland | D9/99 |
| 2,804,258 | 8/1957 | Petter | 229/87 F |
| 2,878,985 | 3/1959 | Rossum | 229/87 F |
| 2,919,846 | 1/1960 | Allen | 229/87 F |
| 2,929,724 | 3/1960 | Farrell | 426/121 |
| 2,940,655 | 6/1960 | Dunning | 229/87 F |
| 2,963,215 | 12/1960 | Saidel et al. | 426/121 |
| 2,964,227 | 12/1960 | Goldsholl | 229/21 |
| 2,965,283 | 12/1960 | Dunning | 229/87 F |
| 2,966,293 | 12/1960 | Goldsholl | 229/8 |
| 2,978,165 | 4/1961 | Bolding | 229/87 F |
| 2,996,236 | 8/1961 | Barr | 426/121 |
| 3,010,571 | 11/1961 | Transport | 229/8 |
| 3,100,597 | 8/1963 | Saidel et al. | 229/87 F |
| 3,100,598 | 8/1963 | Saidel et al. | 229/87 F |
| 3,122,301 | 2/1964 | Barr | 229/87 F |
| 3,126,145 | 3/1964 | Struble | 229/8 |
| 3,343,743 | 9/1967 | Hamilton et al. | 229/8 |
| 3,381,885 | 5/1968 | Seiferth et al. | 229/8 |
| 3,703,384 | 11/1972 | Seiferth et al. | 426/121 |
| 3,803,332 | 4/1974 | Seiferth et al. | 426/121 |
| 3,929,222 | 12/1975 | Smith et al. | 229/8 |
| 3,978,260 | 8/1976 | Dobbins et al. | 426/121 |
| 4,210,240 | 7/1980 | Fricano | 206/45.31 |

*Primary Examiner*—Steven L. Weinstein

*Attorney, Agent, or Firm*—William A. Aguele; Harry W. Hargis, III; Joseph J. Brindisi

[57] ABSTRACT

New bacon packaging is disclosed. The stiffening packaging element, commonly known as a bacon board, has full width top and bottom panels which support the bacon from the bottom and cover it on the top. Special cover flaps on the ends of the top panel are defined by transverse lines of weak bending resistance. The cover flaps, which function to cover the ends of the array of bacon, have segmental arcuate lines of weak bending resistance extending from the free edge of the cover flaps to the corresponding transverse line, and back to the free edge.

7 Claims, 9 Drawing Figures

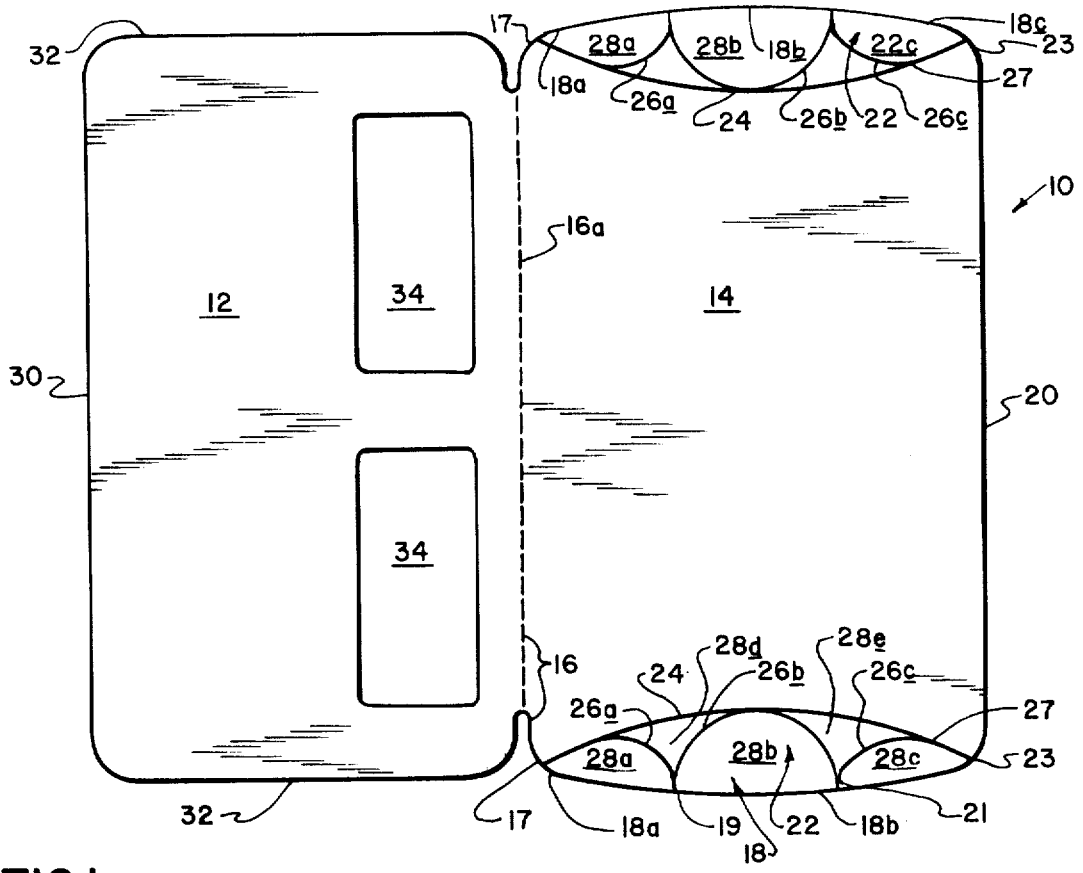
FIG.1
FIG.2
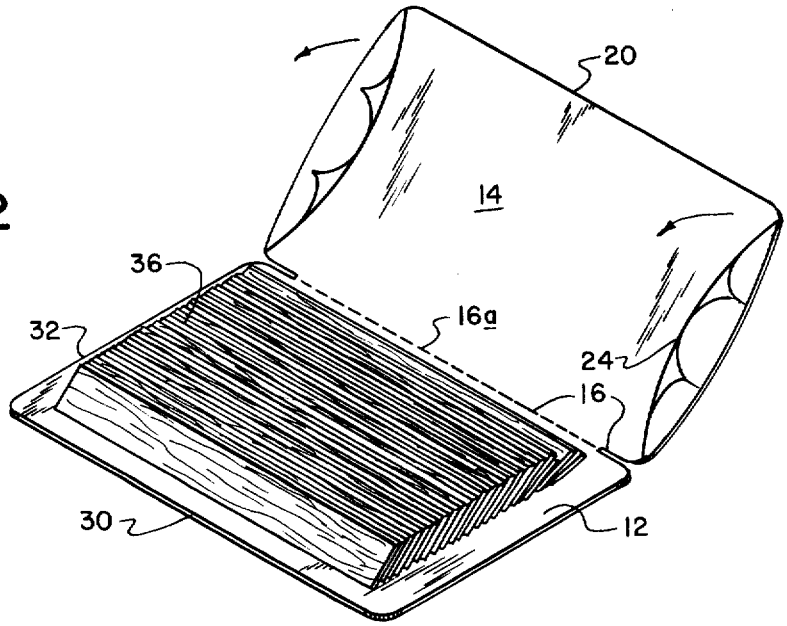

PACKAGE INCLUDING PRODUCT SUPPORT INSERT

BACKGROUND OF THE INVENTION

In the packaging of sliced meat products, such as bacon or the like, it has become common practice to support the slices in a shingled array on a stiffening packaging element. In the subsequent process of vacuum sealing, the packaging element and product are enclosed in plastic films, the entire package is evacuated by a vacuum means, and the films are heat sealed together to close the package. In the finished package, commonly referred to as a vacuum package, the plastic films conform to the combination of the stiffening packaging element and the shingled array of product. Typical packages and packaging elements in the prior art are shown by the following U.S. design and utility patents:

U.S. Pat. No. Des. 235,974
U.S. Pat. No. Des. 250,173
U.S. Pat. No. 2,929,724
U.S. Pat. No. 2,963,215
U.S. Pat. No. 2,965,283
U.S. Pat. No. 3,100,597
U.S. Pat. No. 3,100,598
U.S. Pat. No. 3,703,384
U.S. Pat. No. 3,803,332
U.S. Pat. No. 3,978,260

Conventional stiffening packaging elements are of two general types. In the first type, the packaging element has a full size supporting bottom panel and a substantially smaller top retaining panel. This type is illustrated in FIGS. 1, 3, and 5 of the above cited U.S. Pat. No. 3,803,332. The second type of packaging element has both a full size supporting bottom panel and a full size retaining top panel.

This invention is a new stiffening packaging element of the second type, having both a full size supporting bottom panel and a full size retaining top panel.

SUMMARY OF THE INVENTION

In brief, the invention is a stiffening paperboard packaging element adapted to support and retain sliced product in a shingled array, the element having a supporting panel and a retaining panel. The supporting and retaining panels each are generally rectangular, having two longer sides and side edges defining the length of each panel and two shorter ends and end edges defining the width of each panel. The two panels are joined together by a hinge line along common side edges. The retaining panel has, on each of its ends, a transverse line of weak bending resistance extending in a continuous arc, from the vicinity of the intersections of the common side edge and the end edges, inwardly of the end edges, across the width of the retaining panel, to the adjoining intersection of the same respective end edges and the opposite side edge. The transverse lines of weak bending resistance and their respective end edges define cover flaps on the ends of the retaining panel. Each cover flap has a series of segmental lines of weak bending resistance extending from the corresponding end edge substantially to the corresponding transverse line of weak bending resistance and back to the corresponding end edge. The supporting panel has sides and ends corresponding to the sides and ends of the retaining panel respectively when the retaining panel overlies the supporting panel. The ends of the supporting panel are devoid of lines of weak bending resistance corresponding to the lines of weak bending resistance on the cover flaps.

In preferred embodiments, each cover flap has three of the segmental lines. Extensions of the portions of the end edges adjacent the side edges form angles greater than ninety degrees with extensions of the side edges, and extensions of the portions of the end edges remote from the side edges form right angles with extensions of the side edges. In this preferred embodiment, as in other embodiments, the segmental lines on the end flaps are arcuate.

BRIEF DESCRIPTION OF THE DRAWINGS

FIG. 1 is the plan view of a blank of the packaging element of this invention.

FIG. 2 is a perspective view of a partial package assembly including the packaging element of FIG. 1 and an array of product on the supporting panel.

DETAILED DESCRIPTION OF THE ILLUSTRATED EMBODIMENT

Figure 3:
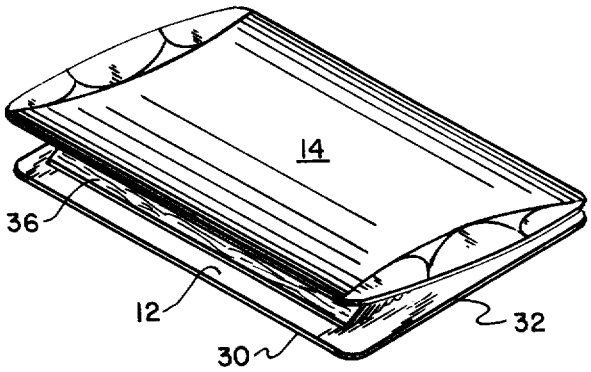
FIG. 3 shows the partial assembly with the retaining panel folded loosely over the supporting panel and the product, ready for the vacuum sealing operation.

The packaging element of this invention is generally designated as 10 in FIG. 1, and is composed of supporting panel 12 and retaining panel 14. Supporting and retaining panels 12 and 14 are generally rectangular, each having two longer sides generally identified with corresponding side edges and two shorter ends generally identified with end edges. Supporting and retaining panels 12 and 14 are joined together along their common side edges 16 such that side edges 16 form a fold line 16*a*.

End edges 18, on each end of panel 14, are divided into three distinct edge segments 18*a*, 18*b*, and 18*c*. On each end edge, edge segment 18*a* extends away from side edge 16 at point 17 toward side edge 20 of panel 14 along a generally straight line, the extension of the straight portion of which forms an angle greater than ninety degrees with the extension of the straight portion of side edge 16. Segment 18*a* terminates at a point 19 intermediate 16 and 20. Edge segment 18*b* extends, at a right angle to edge 16, from point 19 toward edge 20 to a second point 21 intermediate edges 16 and 20. Edge segment 18*c* extends along a generally straight line, the extension of the straight portion of which forms an obtuse angle with the extension of the straight portion of edge 20; segment 18*c* extending from point 21 to side edge 20 at point 23. It will be appreciated from the above description that the designations 18*a*, 18*b* and 18*c* individually refer to the three respective edge segments, while the designation 18 refers to the combined total extent of the three segments which encompass the entire end edge of panel 14.

Each end of retaining panel 14 has a cover flap 22, bounded on its periphery by a combination of transverse line of weak bending resistance 24 and end edge 18. Lines of weak bending resistance 24 extend in continuous arcs on retaining panel 14 from the vicinity of points 17 identified by the intersection of side edge 16 with end edges 18, inwardly of the end edges, across the width of retaining panel 14, to points 23 at the adjoining intersections of the respective ones of end edges 18 with side edge 20. Within each cover flap 22 are segmental arcuate lines of weak bending resistance generally designated 26. The specific segmental arcuate lines are 26*a*, 26*b*, and 26*c*. Line 26*a* extends from point 17 in an arc initially following along line 24; and then diverging toward edge 18 and intersecting edge 18 at point 19. Line 26*b* extends in a continuous arc from edge 18 at point 19 to transverse line 24 and back to edge 18 at point 21. Line 26*c* extends in a continuous arc from edge 18 at point 21 to line 24 and generally follows line 24 to point 23 at the intersection of line 24 with edges 18 and 20. As illustrated, the arc of line 26*c* has a changing center of curvature which is most pronounced at the point 27 where it joins transverse line 24 and adopts the center of curvature of line 24. Lines 26*a* and 26*c* have relatively constant centers of curvature over their lengths. The flap structure thus defined by lines 18, 24 and 26 on cover flap 22 consists of five flap segments. Flap segments 28*a*, 28*b* and 28*c* are enclosed by segmental arcuate lines 26*a*, 26*b* and 26*c* respectively in combination with edge segments 18*a*, 18*b*, and 18*c*. Flap segment 28*d* is enclosed by portions of lines 24, 26*a* and 26*b*. Flap segment 28*e* is enclosed by portions of lines 24, 26*b*, and 26*c*. The degrees of constancy of the centers of curvature of arcuate lines 26 may be adjusted substantially for any given arc without seriously affecting the function of flap 22. Similarly a short space may exist between the arcuate lines 26 at points 19 and 21.

Lines 24, 26*a*, 26*b* and 26*c* are typically formed by crease scoring. Other methods of generating weak bending resistance are known to those skilled in the art, and may be used. Fold line 16*a* is typically formed by perforations. Similarly, equivalent means may be effectively used here.

As described above, edge 20 extends from point 23 on one end of panel 14 to point 23 on the other end of the panel. Line 16, which includes fold line 16*a*, extends from point 17 on one end of panel 14 to point 17 on the other end of the panel. Thus it is clear that edges 16 and 20 include a substantial portion of the rounded corners.

Panel 12 has a side edge 30 remote from common side edge 16 and corresponding to edge 20 of panel 14 when panel 14 overlies panel 12. End edges 32 on panel 12 similarly correspond to end edges 18 on panel 14. A conventional pattern of apertures 34 in panel 12 provides for viewing a representative slice of the product in the closed package.

The invention is herein described as it is used with sliced bacon. Skilled artisans appreciate that it can be used for a variety of products. In FIG. 2, the packaging element has sliced bacon 36 arranged on the supporting panel 12. The arrows leading from the retaining panel indicate movement of that panel to close the package and prepare it for the vacuum sealing operation, where it is sealed in plastic films. FIG. 3 shows the package with retaining panel 14 folded over the supporting panel 12 and the bacon 36, ready for vacuum sealing. The amount of curvature of panel 14 and the degree to which it conforms to the bacon 36, as in FIG. 3, is somewhat dependent on the stiffness of the material used. In the embodiment shown, the material is wax-coated paperboard which has a thickness of about 0.010 inch, and which is a common material for use with package supporting and stiffening elements.

The package shown in FIG. 3 is then vacuum sealed in plastic film in a conventional vacuum sealing operation, described further hereinafter.

Figure 4:
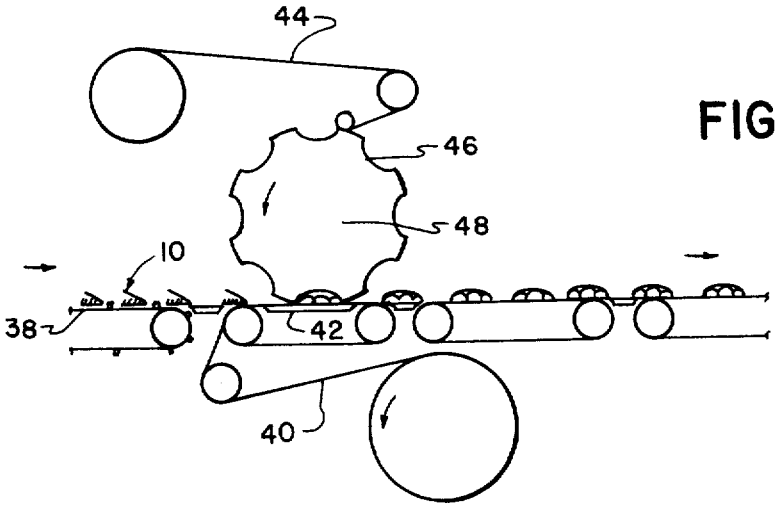
FIG. 4 shows a general arrangement of machinery which may be used with the packaging element of this invention.
Figure 5:
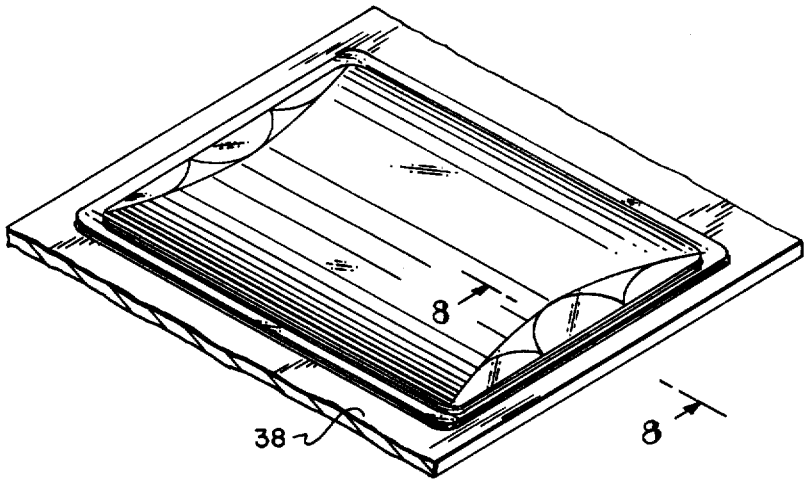
FIG. 5 shows the package in a transitional stage of evacuation.

The best mode contemplated for using the invention as a packaging element is shown in FIG. 4. A package sub-assembly including packaging element 10 and bacon 36, is fed by an incoming conveyor 38 onto a continuous length of non-forming plastic film 40 which is supported by a rigid support member 42. Non-forming plastic film is a relative term which means a film whose physical properties resist plastic deformation under the conditions it encounters in the vacuum sealing operation. A portion of a continuous length of a second film 44, which is a forming film, is introduced into a vacuum forming die 46 on a rotating drum 48. Die 46 forms the above mentioned portion of film 44 into a pocket by conventional means of heat and vacuum. Rotation of drum 48 is synchronized with incoming conveyor 38 so that the formed pocket on film 44, which will form the top film on the package rotates into position over the package sub-assembly as the sub-assembly moves directly under drum 48. Thus the sub-assembly and the formed portion of the top film are brought together with the surfaces of films 40 and 44 facing each other around the periphery of the package sub-assembly. Conventional heat seal bars form seals along the side edges, and along the major portions of the end edges, of the package. The films in this first package are left unsealed along a portion of each end edge of the package. The package is then moved to the next work station as drum 48 rotates the next pocket on film 44 over the next package sub-assembly. Vacuum devices are inserted into the first package through the unsealed portions of each end edge, and the package is evacuated. The vacuum devices are then removed and the unsealed portion of each end edge is immediately closed and sealed by a second set of heat seal bars.

Figure 6:
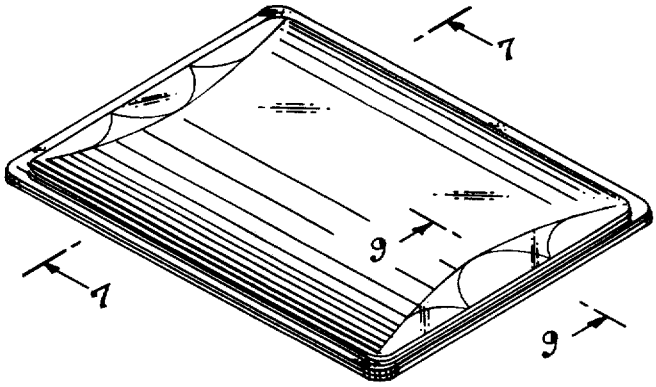
FIG. 6 shows a perspective view of the finished package.
Figure 7:
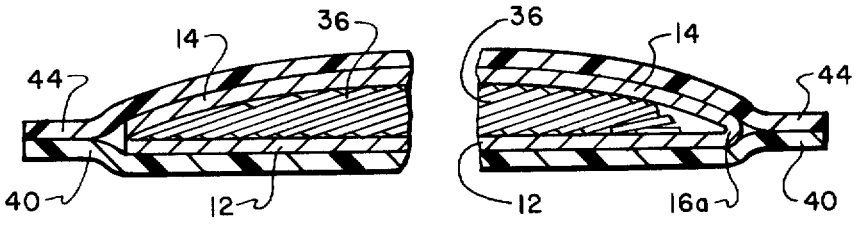
FIG. 7 shows a partial view of a cross-section taken at 7—7 of FIG. 6.
Figure 8:
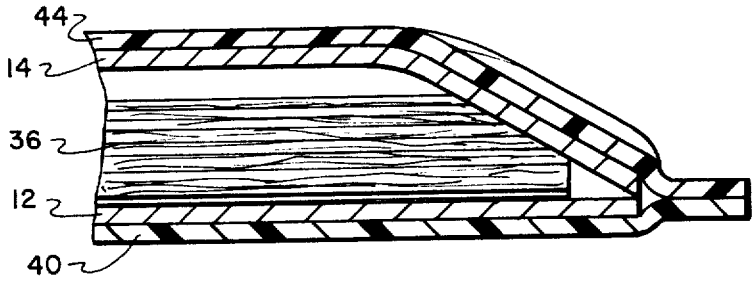
FIG. 8 is an enlarged cross-section of a portion of the package in the transitional stage, taken at 8—8 of FIG. 5.
Figure 9:
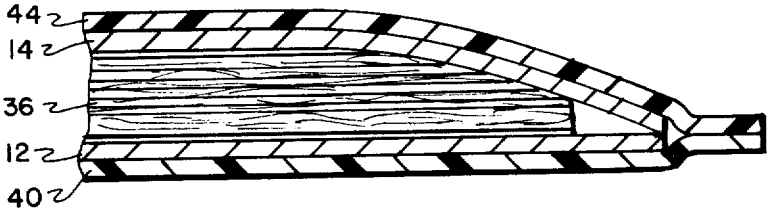
FIG. 9 shows an enlarged cross-section of a portion of the package taken at 9—9 of FIG. 6.

In the thus formed and sealed package, the top film 44 conforms to panel 14 and holds panel 14 firmly against the product on the top, and on the ends. As a result of the evacuation process, film 40 conforms to panel 12. The two films 40 and 44, thus form a unitary film enclosure conforming to element 10 and forcing it to conform closely to the arrayed product. The formed package has the excess film trimmed off and is then complete, as shown in FIG. 6.

In the preferred embodiment, the length of panel 14 is substantially identical to the length of panel 12 when measured along the side edges 16, 20, and 30. In accordance with the above description of the obtuse angularities of edge segments 18*a* and 18*c* with their respective edges 16 and 20, panel 14 is longer than panel 12 when measured in its central portion, such as between edge segments 18*b* on the opposite ends of panel 14.

The packaging element of this invention has been described as it cooperates and is used, with the other elements of the package, and with the packaging machinery. While the description broadly incorporates these other elements and the machinery, it is not intended that the invention be limited to such incorporations. Rather, the invention is to be limited only by the scope of the appended claims.

Having described the invention, what is claimed is:

1. Paperboard and plastic film packaging including an element adapted to support and retain sliced product in a shingled array, and to facilitate substantially smooth disposition thereabout of the plastic film and subsequent sealing thereof to form a unitary film enclosure for said element and said product, said packaging comprising:

a supporting panel and a retaining panel, said supporting and retaining panels each being generally rectangular, having two longer sides and side edges defining the length of each panel and two shorter ends and end edges defining the width of each panel, and being joined together by a hinge line along common side edges, such that said retaining panel may be rotated about said hinge line and over said supporting panel;

said retaining panel having, on each end thereof, a transverse line of weak bending resistance extending in a continuous arc, from the vicinity of the intersections of said common side edge and said end edges, inwardly of said end edges, across the width of said retaining panel, to the adjoining intersection of the same respective end edges and the opposite side edge, said lines of weak bending resistance and their respective end edges defining cover flaps on the ends of said retaining panel;

each said cover flap having segmental lines of weak bending resistance extending from the corresponding end edge substantially to the corresponding transverse line of weak bending resistance and back to the corresponding end edge; and said supporting panel having sides and ends corresponding to the sides and ends of said retaining panel respectively when said retaining panel overlies said supporting panel, and each said cover flap being bendable about said lines of weak bending resistance to engage the corresponding end of said retaining panel with the corresponding end of said support panel, said ends of said supporting panel being devoid of lines of weak bending resistance corresponding to both said transverse and said segmental lines of weak bending resistance on said cover flaps, wherein disposition of the plastic film wrapped about said packaging element and its supported and retained sliced product and subjection to evacuation and a sealing force is effective to urge said panels against said product and to collapse said cover flaps about said lines of weak bending resistance to urge the collapsed cover flaps against said product and the corresponding end of said supporting panel to provide a smooth surface of the collapsed cover flaps over which cover flaps the plastic film conforms.

2. Packaging as in claim 1 wherein said segmental lines on said cover flaps are arcuate.

3. Packaging as in claim 1, each said cover flap having three of said segmental lines.

4. Packaging as in claim 3 wherein extensions of generally straight portions of said end edges adjacent said side edges form angles greater than ninety degrees with extensions of generally straight portions of said side edges.

5. Packaging as in claim 3 wherein extensions of generally straight portions of said end edges adjacent said side edges form obtuse angles with extensions of generally straight portions of said side edges and wherein extensions of the portions of generally straight portions of said end edges remote from said side edges form right angles with extensions of generally straight portions of said said edges.

6. Packaging as in claim 4 wherein extensions of generally straight portions of said end edges remote from said side edges form right angles with extensions of generally straight portions of said side edges.

7. Packaging as in claim 3, 4, or 5 wherein said segmental lines on said cover flaps are arcuate.

* * * * *